United States Patent [19]

Mimura

[11] 4,425,189

[45] Jan. 10, 1984

[54] DEHYDRATING BLADE FOR PAPER MACHINE

[75] Inventor: Gen Mimura, Katsuta, Japan

[73] Assignee: Hitachi Chemical Company, Ltd., Tokyo, Japan

[21] Appl. No.: 335,693

[22] Filed: Dec. 30, 1981

[30] Foreign Application Priority Data

Mar. 25, 1981 [JP] Japan ..... 56-42783

[51] Int. Cl.[3] ..... D21F 1/48; D21F 1/54

[52] U.S. Cl. ..... 162/352; 162/374

[58] Field of Search ..... 162/352, 374

[56] References Cited

U.S. PATENT DOCUMENTS

| | | | |
|---|---|---|---|
| 3,793,140 | 2/1974 | Corbellini | 162/352 |
| 3,928,125 | 12/1975 | Poeschl | 162/374 |
| 3,975,568 | 8/1976 | Rudress | 162/374 |
| 4,238,286 | 12/1980 | Poeschl | 162/374 |
| 4,334,958 | 6/1982 | Baluha | 162/352 |

FOREIGN PATENT DOCUMENTS

| | | | |
|---|---|---|---|
| 2030152 | 10/1970 | France | 162/352 |

*Primary Examiner*—Steve Alvo

*Attorney, Agent, or Firm*—Antonelli, Terry & Wands

[57] ABSTRACT

A dehydrating blade for a paper machine comprising a surface portion made of ceramics, a base portion made from a synthetic resin material and having a T groove on the undersurface thereof, and a reinforcing material the top portion of which contacts with the undersurface of the surface portion and is placed in a groove formed by two projecting portions formed on the undersurface of the surface portion and which is buried in the base portion, is improved in preventing the blade from warping. When the base portion has on or more slits therein, the warping of the blade can be prevented completely.

12 Claims, 10 Drawing Figures

DEHYDRATING BLADE FOR PAPER MACHINE

This invention relates to a dehydrating blade for hydrofoil type and vacuofoil type paper machines.

As dehydrating blades for paper machines, there have recently been used those made of ceramics, particularly sintered alumina ceramics, because of their excellent properties and long life.

Figure 1:
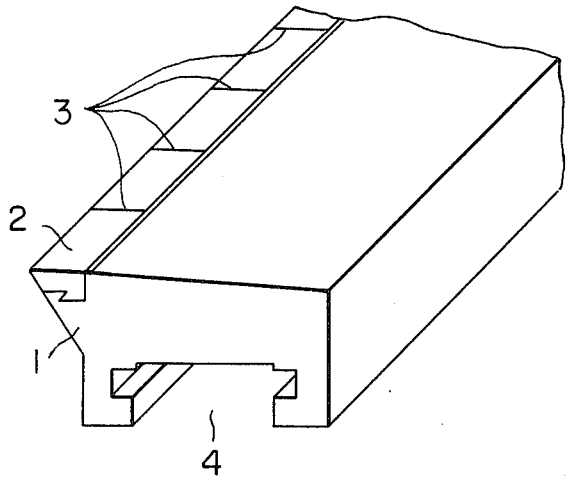
FIG. 1 PRIOR ART

A long dehydrating blade used in the wire part of paper machine in a paper mill comprises, for example as shown in the attached FIG. 1, a base portion 1 made from a synthetic resin such as polyethylene, polyester, FRP (fiber reinforced plastics), or the like having a hollow portion (T groove) 4 on the under surface thereof so as to fit in and slide on a supporting rail and to make taking the blade out and putting it in the paper machine easy, and a surface portion 2 fixed by burying ceramics or tungsten carbide or inserting ceramics. But such a conventional blade has defects in that since the base portion 1 made of a synthetic resin material is small in rigidity, the blade is deflected at the time of installing the blade in a paper machine, which results in bringing about differences in level or clearances at seams 3 on the surface portion and giving ununiform paper having stripes therein since paper travels on such an uneven surface portion 2.

Figure 2:
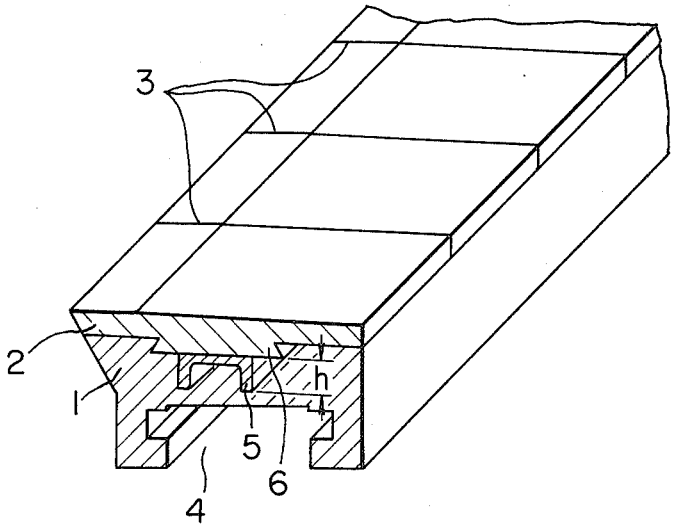
FIG. 2 PRIOR ART

In order to improve such defects mentioned above, there was proposed a dehydrating blade as shown in the attached FIG. 2 comprising a surface portion 2 made of ceramics and a base portion 1 made from a synthetic resin material molded integrally with the surface portion and having a hollow portion 4 on the undersurface thereof, and a reinforcing material 5 made of steel buried in the base portion so as to prevent the blade from deflection, said surface portion 2 having a dovetail 6 so as to make sure the fitting of the base portion 1 and the surface portion 2, and said blade was improved not only in making the exchange of blades easy but also in avoiding the grinding working so as to remove the differences of the levels of individual surface portions. But said blade had defects in that since the height of the blade has a limit and the thickness of the surface portion 2 cannot be reduced so much, the height (h) of the reinforcing material 5 is thus limited, which results in giving insufficient strength for preventing the reinforcing material 5 from warping at the direction of its length, particularly when the blade is long.

It is an object of this invention to provide a dehydrating blade for a paper machine overcoming the defects mentioned above.

This invention provides a dehydrating blade for a paper machine comprising a surface portion made of ceramics and a base portion made from a synthetic resin material and having a hollow portion (T groove) on the undersurface thereof for sliding on a supporting rail for the dehydrating blade, said surface portion having at least two projecting portions on the undersurface thereof for burying them in said base portion, and a reinforcing material being buried in said base portion and the top portion of the reinforcing material contacting with the undersurface of the surface portion and placed in a groove or hollow portion formed by at least two projecting portions of the surface portion.

Figure 3:
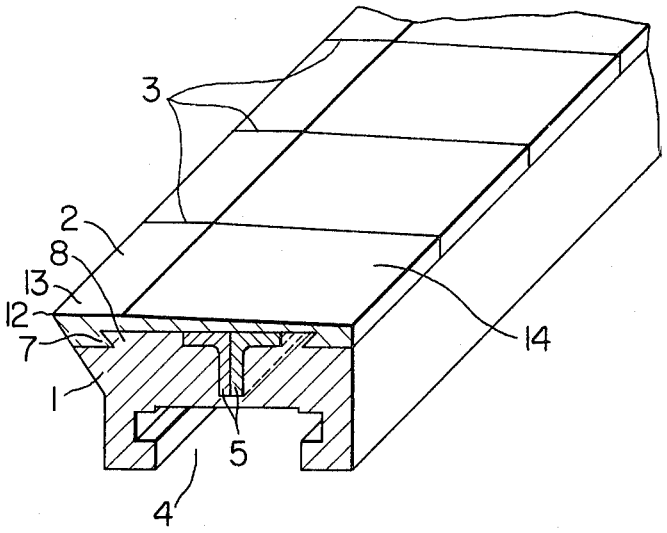
Figure 4:
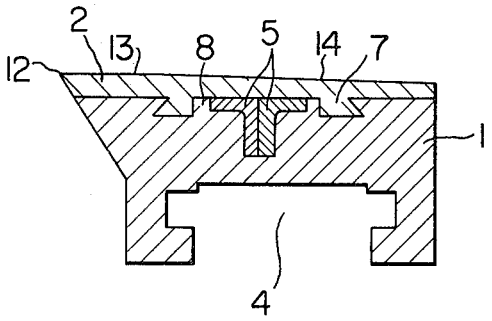
Figure 5:
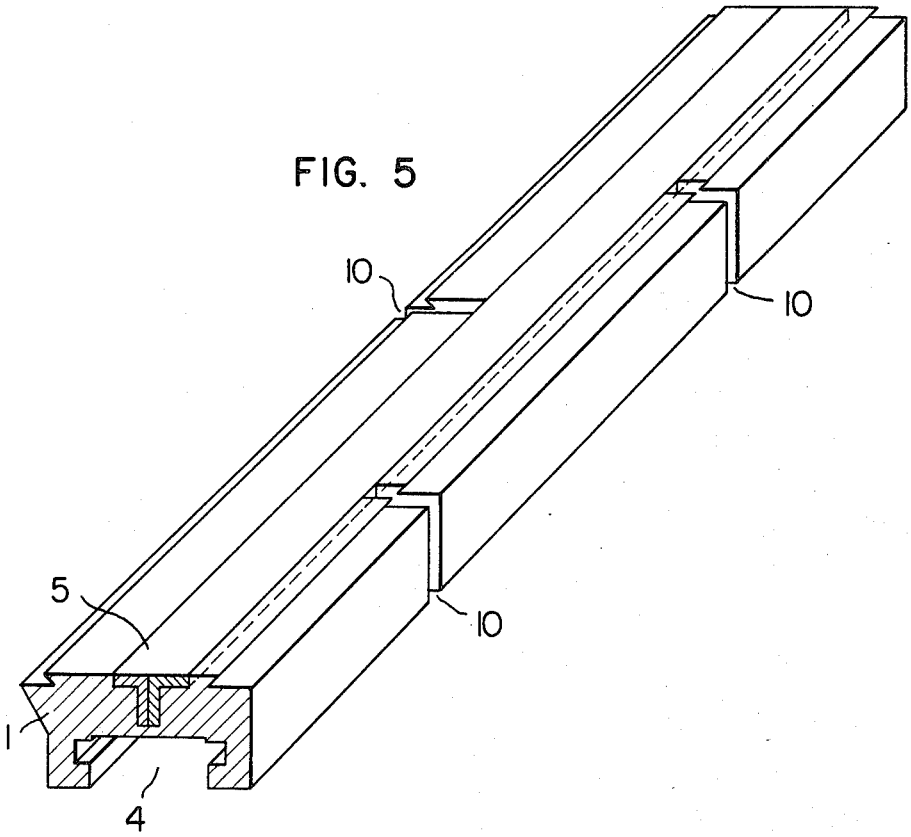
Figure 6:
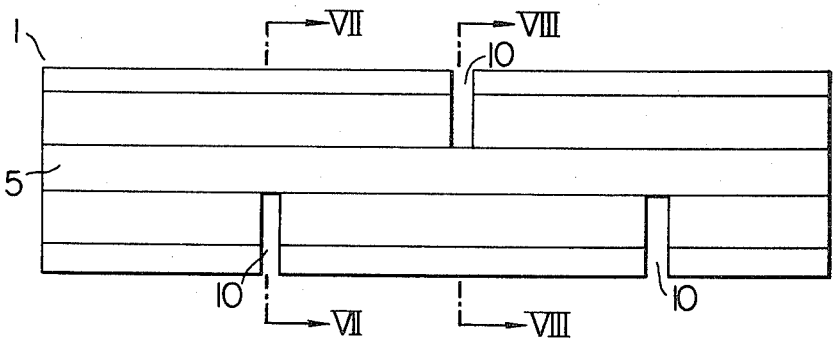
Figure 7:
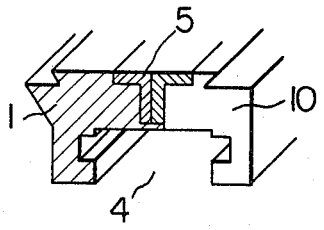
Figure 8:
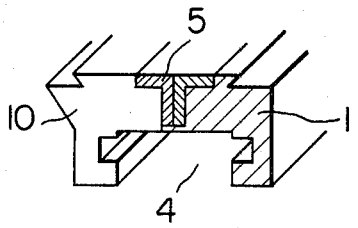
Figure 9:
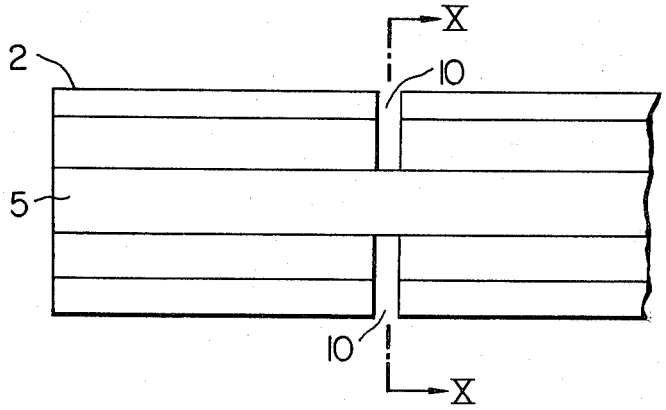
Figure 10:
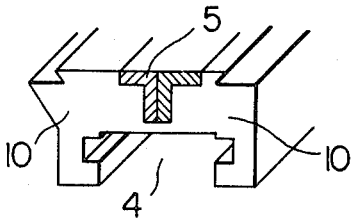

In the attached drawings,

FIGS. 1 and 2 are perspective views of conventional blades of taking-out and putting-in type, FIG. 3 is a perspective view of one example of the blade according to this invention, FIG. 4 is a cross-sectional view of another example of the blade according to this invention, FIG. 5 is a perspective view of the base portion having slits therein, FIG. 6 is a plane view of the base portion, FIG. 7 is a cross-sectional view taken along the line VII—VII of FIG. 6, FIG. 8 is a cross-sectional view taken along the line VIII—VIII of FIG. 6, FIG. 9 is a plane view of the base portion, and FIG. 10 is a cross-sectional view taken along the line X—X of FIG. 9.

This invention will be explained in detail referring to FIGS. 3 and 4.

The surface portion 2 is made of ceramics, for example, sintered alumina by a conventional technique and has a front portion 12 with an acute angle, a flat plane 13 and a declined plane 14. The flat plane 13 supports a wire screen and water is removed from a pulp slurry by suction by vacuum produced by the flat plane with an aid of the inclined plane 14 at the time of running of the wire screen on the flat plane. The surface portion 2 has at least two projecting portions 7 at the both ends as shown in FIG. 3 or inner portions as shown in FIG. 4. The projecting portions forms a groove or hollow portion 8 and are combined with the base portion 1.

The base portion 1 having a hollow portion (T groove) 4 for sliding on a supporting rail of a paper machine is made from a synthetic resin material, preferably a thermosetting resin. Examples of the thermosetting resins are epoxy resins, unsaturated polyester resins, phenolic resins, melamine resins and urea resins.

In the base portion 1, a reinforcing material 5 is buried as shown in FIGS. 3 and 4. The reinforcing material made of steel, aluminum, etc. should be placed in the groove made by the two projecting portions 7 and be in the form of the letter "T". Since a L-type steel is available commercially, two L-type steel is combined so as to make the form of "T". By the use of T-type reinforcing material, the flow of a synthetic resin at the time of molding the base portion becomes better compared with the case of the reinforcing material in the form of "⊓" as shown in FIG. 2, which results in making the base portion containing the T-type reinforcing material as shown in FIG. 3 or 4 stronger than that containing the ⊓-type reinforcing material as shown in FIG. 2. Further, the resulting blades as shown in FIGS. 3 and 4 show better results as for preventing these blades from warping than the blade of FIG. 2.

In practical production of the dehydrating blade of this invention, the surface portion 2 is placed in a mold so as to make the main surface of the surface portion contact with the mold surface and the projecting portions 7 standing upwards, the reinforcing material 5 is then placed on the surface portion 2 within the groove 8, and then a liquid resin is poured and cured so as to mold the blade integrally. In such a case, since the reinforcing material 5 can be set in the mold stably, i.e., in the form of reversed T, the production efficiency of the dehydrating blade can be increased remarkably.

Since steel material is used as a reinforcing material, the weight of the base portion becomes much heavier due to the weight of the steel material, which results in lowering in workability of taking-out and putting-in of the blade. In order to produce a lightweight base portion, it is preferable to use a synthetic resin material containing preferably 10 to 65% by volume of filler having a specific gravity of 0.9 or less in the form of hollow microsphere.

The filler should be hollow microspheres having a specific gravity of 0.9 or less. When the specific gravity is larger than 0.9, an object of producing a lightweight blade cannot be attained. Considering the specific gravity and reinforcing effect, the filler should be in the form of hollow microsphere. The particle size of microspheres is sufficient when it is in the range of 5 to 300 μm. Examples of the fillers are inert siliceous materials, e.g., Fillite 52/7 having a composition of $SiO_2$ 55–61%, $Al_2O_3$ 26–30%, $Na_2O+K_2O$ 0.5–4%, and $Fe_2O_3$ 4% or less, by weight (manufactured by Nippon Fillite K.K., in Japan), microcapsules made from synthetic resins conventionally used or balloons made from organic materials. If the amount of the filler is less than 10% by volume, an effect of reducing the weight is insufficient. On the other hand, if the amount of the filler is more than 65% by volume, a conventional casting operation cannot be applied, which results in making the molding of the synthetic resin complicated and also making properties of the products thus produced not uniform. The molding of the base portion can be carried out by a conventional technique, e.g., casting. For example, the base portion 1 can be obtained by mixing 100 parts by weight of an epoxy resin (Epikote 815, Shell Chemical Co.), 43 parts by weight of filler (Fillite 52/7, specific gravity about 0.7, particle size 5–300 μm, Nippon Fillite K.K.) and 40 parts by weight of a curing agent (Epomate B002, Ajinomoto Co., Inc.), casting the mixture into a mold and curing the mixture. The resulting cured product (the base portion) has a specific gravity of about 0.92 to 1.2, which is by for lightweight compared with conventional blades. Therefore, the workability of taking-out and putting-in of the blade can be improved remarkably.

The dehydrating blade usually has a length of 2 to 8 m when used in the wire part in a paper machine. When the blade as shown in FIG. 3 or 4 is still warped at the longitudinal direction of the blade due to mold shrinkage of the synthetic resin material used for producing the base portion, and/or due to difference in thermal expansion coefficients of ceramics and the synthetic resin material, one or more slits are formed in the base portion, preferably almost perpendicular to the longitudinal direction of the base portion.

For making the explanation easy, only the base portion as shown in FIG. 5 is taken out of the dehydrating blade of FIG. 3 wherein the surface portion and the base portion are molded integrally. The length of the blade is, for example, 4 m. FIG. 6 is a plane view of the base portion of FIG. 5, which has three slits 10, two on one side and one on the other side of the base portion separated by the reinforcing material. The width of each slit 10 is about 0.2 mm in this case. The width of slit can be in the range of more than 0.05 mm to 0.5 mm, preferably 0.1 mm to 0.4, more preferably 0.2 to 0.3 mm. If the width is too large, for example more than 0.5 mm, the strength of the base portion is undesirably lowered. On the other hand, if the width is too small, for example 0.05 mm or less, the formation of the slits in the time of molding the base portion becomes difficult, since a thin film is inserted in the mold, followed by pouring the synthetic resin material and removal of the thin film to give preseribed slits.

In the case of the slits shown in FIGS. 5 and 6, each slit is formed as shown in FIG. 7 or 8, about one half of the cross-section of the base portion divided by the reinforcing material 5. But the slit can be formed as shown in FIGS. 9 and 10. Further, the slit 10 is not necessarilly reached the reinforcing material 5 as shown in FIG. 7 or 8 and can exhibit its effect when the slit area is about ⅔ or more of that shown in FIG. 7 or 8.

Distance between slits is not limited, but it is preferable to form slits with a constant distance of, for example, from 2 meter to 20 cm, preferably about 1 m, alternately on one side and on the other side of the base portion separated by the reinforcing material as shown in FIG. 5 or 6. For example, when the length of the blade is 5 m, it is preferable to form four slits with each distance of 1 m, two on one side and the rest two on the other side of the base portion separated by the reinforcing material alternately.

The dehydrating blade having the slitted base portion as shown in FIG. 5 can be used without causing warping at a temperature from −20° C. to +60° C. On the other hand a conventional dehydrating blade as shown in FIG. 2 causes warping with the maximum value of 50 to 100 mm when held at −20° C. for 1 hour.

As mentioned above, the dehydrating blade according to this invention is hardly warped by inserting the reinforcing material into the base portion in the special form, and if necessary by forming one or more slits in the base portion, so that the workability of taking-out and putting-in of the dehydrating blade is improved remarkably. Further, the commercial value of the dehydrating blade of this invention is increased remarkably by removing the defect of warping. In addition the weight of the dehydrating blade can be reduced remarkably by using a synthetic resin containing a special lightweight filler.

What is claimed is:

1. A dehydrating blade for a paper machine comprising a surface portion made of ceramics and a base portion made from a synthetic resin material and having a hollow portion on the undersurface thereof, said surface portion having at least two projecting portions on the undersurface thereof for burying them in said base portion, said two projecting portions forming a groove therebetween, and a reinforcing material being buried in said base portion and the top portion of the reinforcing material contacting with the undersurface of the surface portion and placed in said groove formed by the projecting portions of the surface portion, wherein the reinforcing material is made of steel and in the form of the letter "T", wherein the base portion has a plurality of slits, with the slits being formed substantially perpendicular to the longitudinal direction of the base portion, and wherein the slits are formed with a constant distance alternately on one side and then on the other side of the base portion separated by the reinforcing material.

2. A dehydrating blade according to claim 1, wherein the reinforcing material is made of two L-type steel members combined so as to make the form of the letter "T".

3. A dehydrating blade according to claim 1, wherein said slits each have a width of 0.05 mm to 0.5 m.

4. A dehydrating blade according to claim 3, wherein the width of each of the slits is 0.1 mm to 0.4 mm.

5. A dehydrating blade according to claim 4, wherein the width of each of the slits is 0.2 mm to 0.3 mm.

6. A dehydrating blade according to claim 1, wherein each slit is formed about one-half of the cross-section of the base portion divided by the reinforcing material.

7. A dehydrating blade according to claim 1, wherein the slits formed alternately on one side and then on the other side of the base portion are formed such that pairs of alternately formed slits are formed at the same longitudinal position on opposite sides of the base portion.

8. A dehydrating blade according to claim 1, 6 or 7, wherein said constant distance is 20 cm to 2 m.

9. A dehydrating blade according to claim 1, wherein the synthetic resin is a thermosetting resin.

10. A dehydrating blade according to claim 3, wherein the thermosetting resin is an epoxy resin, an unsaturated polyester resin, a phenolic resin, a melamine resin or a urea resin.

11. A dehydrating blade according to claim 1, wherein the base portion is made from a thermosetting resin containing 10 to 65% by volume of filler having a specific gravity of 0.9 or less in the form of hollow microsphere.

12. A dehydrating blade according to claim 11, wherein the hollow microsphere is made of inert siliceous material.

* * * * *

UNITED STATES PATENT AND TRADEMARK OFFICE

CERTIFICATE OF CORRECTION

PATENT NO. : 4,425,189

DATED : January 10, 1984

INVENTOR(S) : MIMURA

It is certified that error appears in the above-identified patent and that said Letters Patent is hereby corrected as shown below:

On the first page of the patent, left-hand column, in the first line under "[30] Foreign Application Priority Data", please delete "56-42783 and insert therefor --56-42783[U]--.

Signed and Sealed this

*Ninth* Day of *October 1984*

[SEAL]

*Attest:*

GERALD J. MOSSINGHOFF

*Attesting Officer*

*Commissioner of Patents and Trademarks*